US006880364B1

(12) United States Patent
Vidolin et al.

(10) Patent No.: US 6,880,364 B1
(45) Date of Patent: Apr. 19, 2005

(54) FRIENDSHIP BAND WITH EXCHANGEABLE CLOSED LOOP MEMBERS

(75) Inventors: Michael F. Vidolin, 11 Hoffer Ct., Englishtown, NJ (US) 07726; Scott P. Taylor, Ossining, NY (US); Brian S. Keill, 15 Van Zandt Dr., Pearl River, NY (US) 10965-1242

(73) Assignees: Michael F. Vidolin, Englishtown, NJ (US); Brian S. Keill, Pearl River, NY (US)

( * ) Notice: Subject to any disclaimer, the term of this patent is extended or adjusted under 35 U.S.C. 154(b) by 0 days.

(21) Appl. No.: 09/064,973

(22) Filed: Apr. 23, 1998

(51) Int. Cl.[7] ..... A44C 25/00
(52) U.S. Cl. ..... 63/40; 40/633; 40/665
(58) Field of Search ..... 63/40, 3, 3.1, 11, 63/1.11; 40/633, 665, 640; D11/3, 4, 5, 6, 19

(56) References Cited

U.S. PATENT DOCUMENTS 226,564 A * 4/1880 Stone ..... 63/11
1,481,894 A * 1/1924 Fishel ..... 63/4
1,694,703 A * 12/1928 Doppenschmitt ..... 63/11
2,322,461 A * 6/1943 Mariano ..... 63/3
2,378,755 A * 6/1945 Dowling
D158,918 S * 6/1950 Winn
2,653,402 A * 9/1953 Bonagura ..... 63/3 X
2,699,553 A * 1/1955 Byers et al.
3,063,058 A * 11/1962 Vollet
4,060,185 A * 11/1977 Kuroda ..... 224/176
4,179,833 A * 12/1979 Knodel
4,237,702 A * 12/1980 Caverly
4,713,900 A * 12/1987 Calloway, Jr. et al. .... 40/665 X
4,753,086 A * 6/1988 Schmidt ..... 63/3
4,879,882 A * 11/1989 Johnson et al.
4,936,699 A * 6/1990 Yoshida
5,630,329 A * 5/1997 Lauffer et al. ..... 63/5.1
D400,118 S * 10/1998 Itzkowitz
5,816,072 A * 10/1998 Michaels ..... 63/11
6,014,871 A * 1/2000 Romano ..... 63/41

* cited by examiner

*Primary Examiner*—William L. Miller
(74) *Attorney, Agent, or Firm*—Pillsbury Winthrop LLP

(57) ABSTRACT

A friendship band with exchangeable closed loop members is disclosed. The friendship band may be configured to be worn as a wrist bracelet, ankle bracelet, and a necklace. The friendship wrist bracelet includes a wristband formed of stretchable material and having releasable closure means members for opening and closing the wristband. A plurality of closed loop members are slidably removable from the wristband for exchanging with the closed loop members of other ones of the wristbands. Each of the plurality of closed loop members having first indicia thereon for exchanging with the closed loop members of other ones of the wristbands having second, third and fourth indicia thereon.

16 Claims, 6 Drawing Sheets

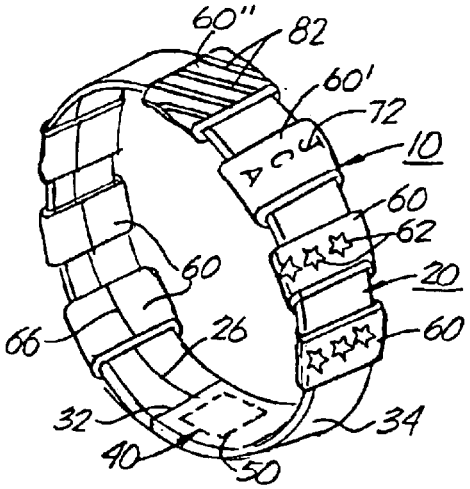
FIG. 5
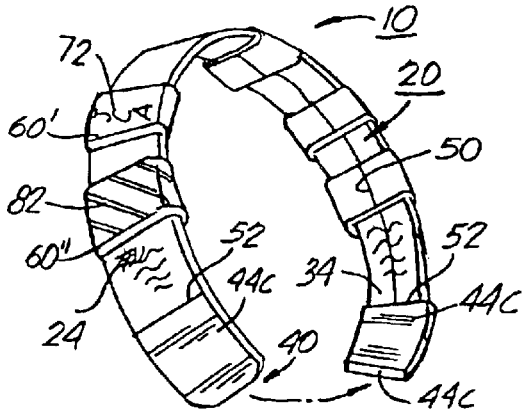
FIG. 4
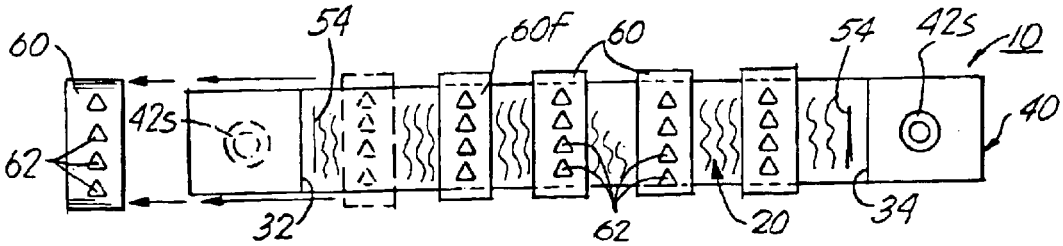
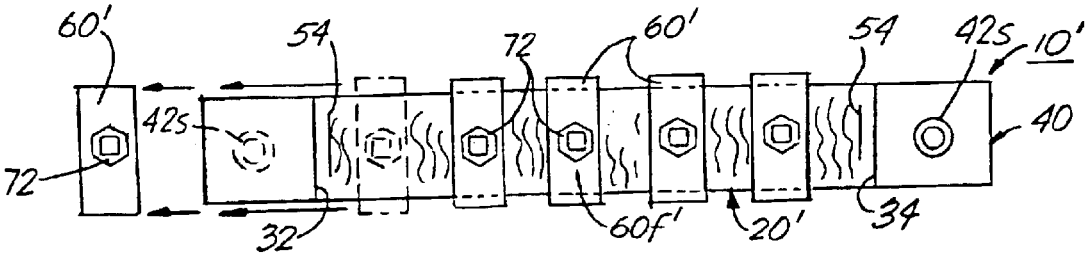
FIG. 6A

FIGURE 7A

400

METHOD OF USE IN OPERATING OF THE FRIENDSHIP BRACELET

410

STEP 1
OPENING THE FRIENDSHIP BRACELET

Opening of the closure means 40 on each wristband sections 20 and 20' of each first and second friendship bracelets 10 and 10' by the first and second wearer's from their respective wrists 12 and 12'.

420

STEP 2
REMOVING A CLOSED LOOP MEMBER

Each wearer then slidably removes from each wristband 20 and 20', one of the plurality of closed loop members 60 and 60' thereon, where each closed loop member 60 and 60' has a first indicia member 62 thereon and a second indicia member 72 thereon, respectively. The first and second indicia members 62 and 72 are different from each other, for example first indicia member 62 is a design in the form of a series of triangles (△) on the front wall 60f of closed loop member 60 and second indicia member 72 is an indicia symbol in the form of a corporate logo on the front wall 60f' of closed loop member 60', as depicted in Figure 6A of the drawings.

430

STEP 3
EXCHANGING EACH OF THE CLOSED LOOP MEMBERS

Each wearer now exchanges each of the removed closed loop members 60 and 60' having first and second indicia members 62 and 72 thereon, respectively, such that the first wearer 12 of the first friendship bracelet 10 receives the closed loop member 60' having the second indicia member 72 thereon and the second wearer 12' of the second friendship bracelet 10' receives the closed loop member 60 having the first indicia member 62 thereon.

FIGURE 7B

440

STEP 4
ATTACHING EACH OF THE CLOSED LOOP MEMBERS

Each wearer would now slidably attach each of the closed loop members 60 and 60' having the first and second indicia members 62 and 72 thereon, on each of the respective exchanged wristband 20 and 20' of the first and second friendship bracelets 10 and 10', respectively, such that closed loop member 60 having the first indicia member 62 thereon is slidably connected to the second wristband section 20' of the second friendship bracelet 10' of the second wearer 12', and the closed loop member 60' having the second indicia member 72 thereon is slidably connected to the first wristband section 20 of the first friendship bracelet 10 of the first wearer 12.

450

STEP 5
CLOSING THE FRIENDSHIP BRACELET

Each wearer would then close the releasable closure means 40 on each of the wristband sections 20 and 20' of each first and second friendship bracelets 10 and 10', such that the first wearer 12 of the first friendship bracelet 10 has a plurality of closed loop members 60 and 60' thereon and wristband section 20 has at least one closed loop member 60' having a second indicia member 72 thereon; and the second wearer 12' of the second friendship bracelet 10' has a plurality of closed loop members 60 and 60' thereon and wristband section 20' has at least one closed loop member 60 having a first indicia member 62 thereon.

FRIENDSHIP BAND WITH EXCHANGEABLE CLOSED LOOP MEMBERS

FIELD OF THE INVENTION

This invention relates to a friendship bracelet with exchangeable elements. More particularly, the bracelet is made of a stretchable band covered with a fabric and having closure means for fastening the ends together. Slidably mounted on the bracelet are a plurality of closed loop members, each having first indicia on them, such that the loop members are slidably removable from the bracelet and are exchangeable with loop members of other bracelets.

BACKGROUND OF THE INVENTION

Clubs, groups, and cliques are formed based on gender, schools, hobbies, sporting activities, work associations and the like. As part of a group, many individuals wear and display articles to identify themselves within that group. These display articles may take a variety of forms such as name tags; jewelry such as bracelets and necklaces; and clothing articles such as hats, jackets, neckties, T-shirts, etc. But within these groups based on gender, school, hobbies, sporting activity, etc., there is no clear way to indicate a friendship with another person within that group or club, etc.

There remains a need for friendship bracelets with removable elements or loop members having indicia thereon which are exchangeable with a friend's bracelet having loop members thereon with different indicia for indicating friendships within a group or clique and to identify members of that friendship group or clique.

DESCRIPTION OF THE PRIOR ART

Bracelets, necklaces, tie clasps, hats, and headbands having changeable elements mounted thereon to be worn on the wrist, neck, head of a person having various designs, appearances, structures, materials of construction and functions have been disclosed in the prior art. For example, U.S. Pat. No. 2,699,553 discloses a novelty hat having changeable symbols removably mounted thereon.

U.S. Pat. No. 4,179,833 discloses a strap-like bracelet having removable tabs with reminder messages on them.

U.S. Pat. No. 4,237,702 discloses a necklace having a plurality of housings with indicia thereon being slidably mounted on a portion of the necklace.

U.S. Pat. No. 4,879,882 discloses a jewelry pendant having changeable elements with indicia thereon.

None of the prior art patents disclose a stretchable friendship bracelet with removable loop members having different indicia thereon which are exchangeable with a friend's bracelet.

Accordingly, it is an object of the present invention to provide a novel friendship bracelet with exchangeable elements thereon, wherein the bracelet is made of a stretchable band covered with a fabric and having means for fastening the ends together.

Another object of the present invention is to provide a friendship bracelet wherein the exchangeable elements are in the form of a plurality of closed loop members having indicia thereon.

Another object of the present invention is to provide a friendship bracelet that may be worn by adults, teenagers, and children of both sexes for indicating membership in friendship groups, cliques, clubs and the like.

Another object of the present invention is to provide a friendship bracelet wherein the indicia may be any design such as designs selected from the group consisting of stars, stripes, hearts, flowers, insects, animals and the like; colors such as red, blue, green, yellow, purple, pink and the like; and indicia symbols such as letters, numbers, initials, names, insignias, emblems and the like.

Another object of the present invention is to provide a friendship bracelet wherein the fastening means for fastening the bracelet ends together include snaps, clasps, hook and loop fasteners (Velcro™ fasteners), buckle and tine members, hook members, or buttons and the like.

Another object of the present invention is to provide a friendship bracelet wherein the bracelet is made of a stretchable elastic band covered with an outer layer of fabric material, in which the fabric material is selected from the group consisting of cotton, rayon, nylon, silk, linen, polyester and combinations thereof.

Another object of the present invention is to provide a friendship bracelet that is durable, light-weight and cleanable by washing for extending the useful life of the bracelet.

A still further object of the present invention is to provide a friendship bracelet that can be mass produced in an automated and economical manner and is readily affordable by the wearer.

SUMMARY OF THE INVENTION

In accordance with the present invention, there is provided a friendship bracelet for wearing on the wrist. The friendship bracelet includes a wristband formed of stretchable material and having releasable closure means for opening and closing the wristband. A plurality of closed loop members are slidably removable from the wristband for exchanging with the closed loop members of other ones of the wristbands. Each of the plurality of closed loop members having a surface with first indicia thereon for exchanging with the closed loop members of other ones of the wristbands having second, third and fourth indicia thereon.

A method of using the friendship bracelet of the present invention including a bracelet having a wristband with a plurality of closed loop members thereon and having releasable closure means; and closed loop members having first indicia thereon, comprising the following steps:

a) Opening of the releasable closure means and slidably removing from the wristband one of the plurality of closed loop members having a first indicia thereon;

b) Exchanging the removed one of the plurality of closed loop members with the closed loop member from another one of the friendship bracelets having second indicia thereon;

c) Sliding the closed loop member from another one of the friendship bracelets onto the wristband; and d) Closing the closure means to retain the wristband on the wrist of the wearer having closed loop members thereon with the first and second indicia thereon.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein:

FIG. 4 is a rear perspective view of the friendship bracelet of the present invention showing the first and second connecting tab members attached to metal or plastic clasping components to form a metal or plastic clasp for joining each wristband end together;

FIG. 5 is a front perspective view of the friendship bracelet of the present invention showing the friendship bracelet in an assembled state and the wristband section in an unstretched configuration having a plurality of closed loop members with indicia thereon and being on the wristband section ready to be worn by a wearer;

FIG. 6A is a top plan view of the friendship bracelet of the present invention showing the slidable removing of a closed loop member having different indicia thereon from first and second friendship bracelets;

FIG. 7A is a block diagram of the method of use for wearing of a friendship bracelet having exchangeable elements by a user, showing the steps of opening the friendship bracelet, the removing of a closed loop member from the friendship bracelet, and the exchanging of each of the closed loop members that are performed in the wearing of the present invention;

FIG. 7B is a block diagram of the method of use for wearing of a friendship bracelet having exchangeable elements by a user showing the steps of attaching each of the closed loop members to different friendship bracelets and closing of the friendship bracelet on each of the wearers that are performed in the wearing of the present invention.

DETAILED DESCRIPTION OF THE PREFERRED EMBODIMENT AND ALTERNATE EMBODIMENT

The friendship bracelet 10 and its component parts for wearing on the wrist 12 of a user of the preferred embodiment of the present invention ate represented in detail by FIGS. 1 through 5 of the drawings. The friendship necklace 100 and its component parts for wearing on the neck of a user of the alternate embodiment of the present invention is represented in detail by FIG. 8 of the drawings. The method of using the friendship bracelet for wearing around the wearer's wrist 12 having various operational steps performed in the exchanging of closed loop members with indicia thereon with other bracelets is disclosed in the preferred embodiment of the present invention and is represented in detail by FIGS. 6A, 6B, 6C, 7A and 7B of the drawings.

Figure 1:
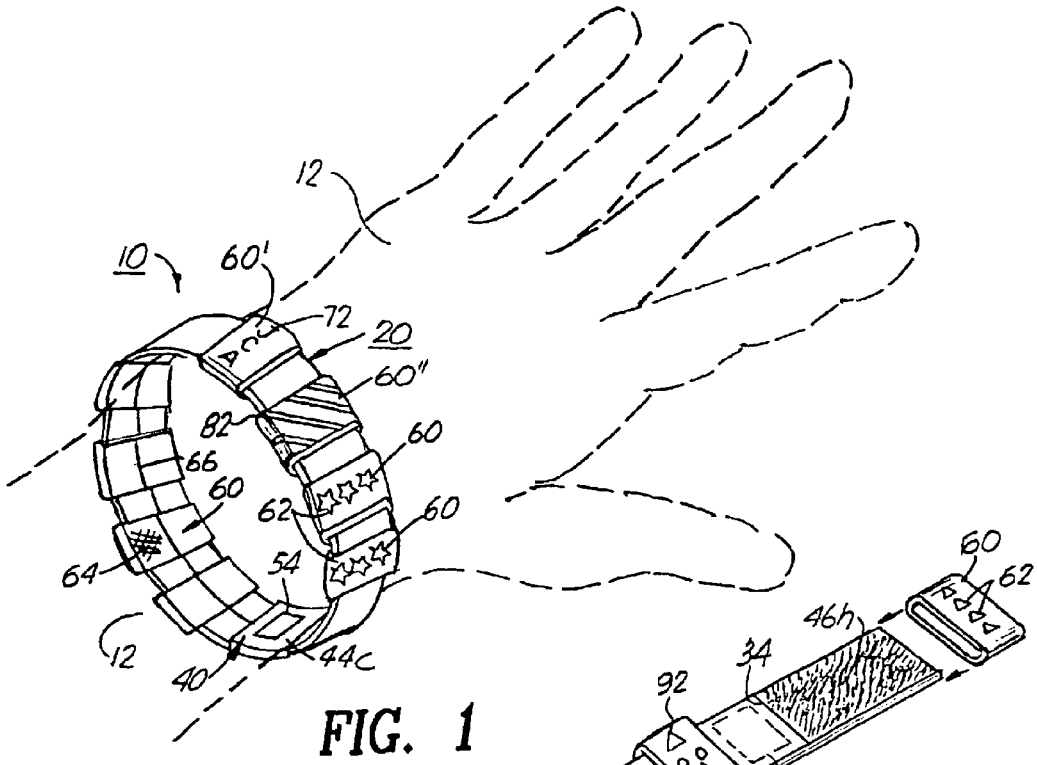
FIG. 1 is a front perspective view of the friendship bracelet of the preferred embodiment of the present invention showing the wristband, the clasp, the plurality of closed loop members having different indicia thereon; and also showing the fig friendship bracelet in an assembled state being in operational use wherein the wristband section is in a fully stretched position on the wearer's wrist.
Figure 2:
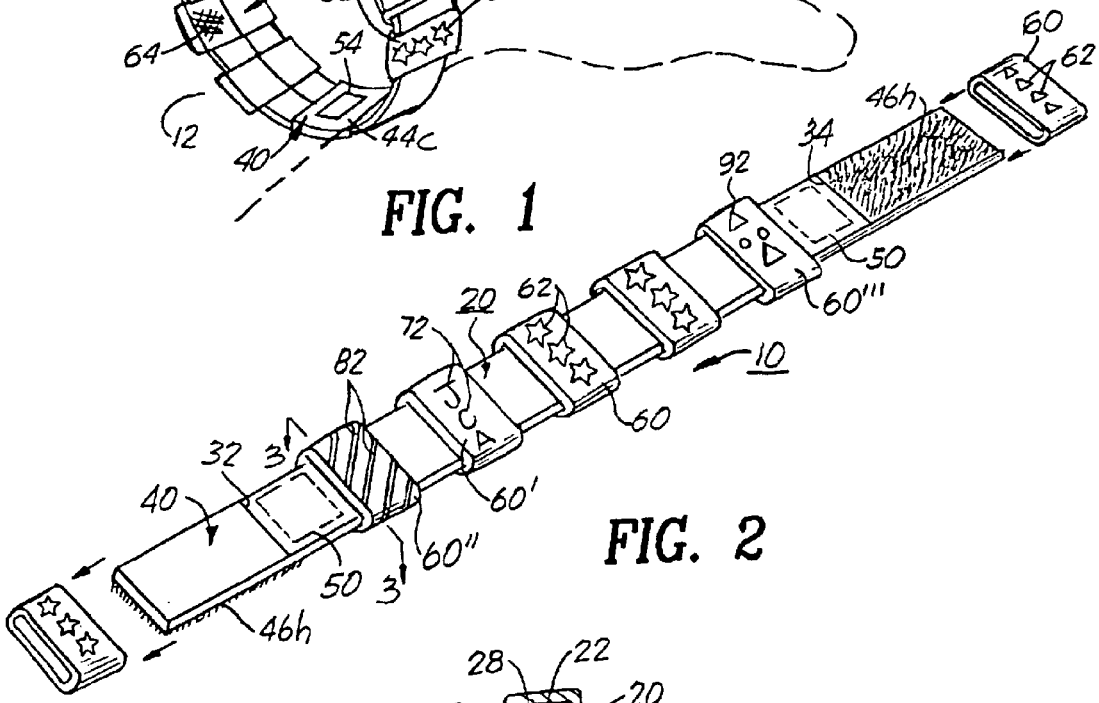
FIG. 2 is a front perspective view of the friendship bracelet of the present invention showing a first friendship bracelet in a partially assembled state and unstretched configuration being readied for receiving a closed loop member from another bracelet onto the wristband section of the first friendship bracelet.
Figure 3:
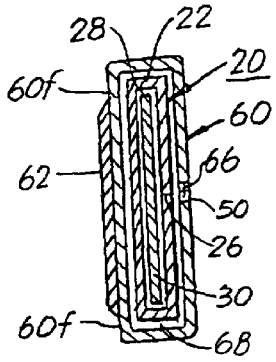
FIG. 3 is an enlarged cross-sectional view of the friendship bracelet of the present invention showing the wristband having an inner elastic section and an outer material layer thereon, a closed loop member having indicia thereon and also showing the closed loop member encircling the wristband section of the friendship bracelet.
Figure 6B:
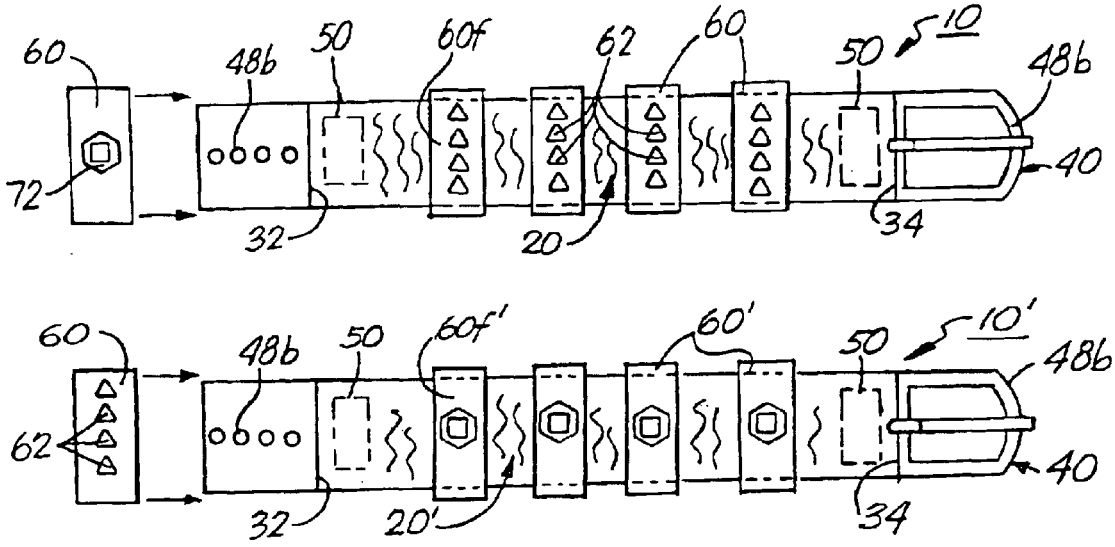
FIG. 6B is a top plan view of the friendship bracelet of the present invention showing the exchanging of each of the closed loop member having different indicia designs thereon and slidably gig attaching the closed loop member having different indicia designs thereon onto wristband sections to each of the other first and second friendship bracelets.
Figure 6C:
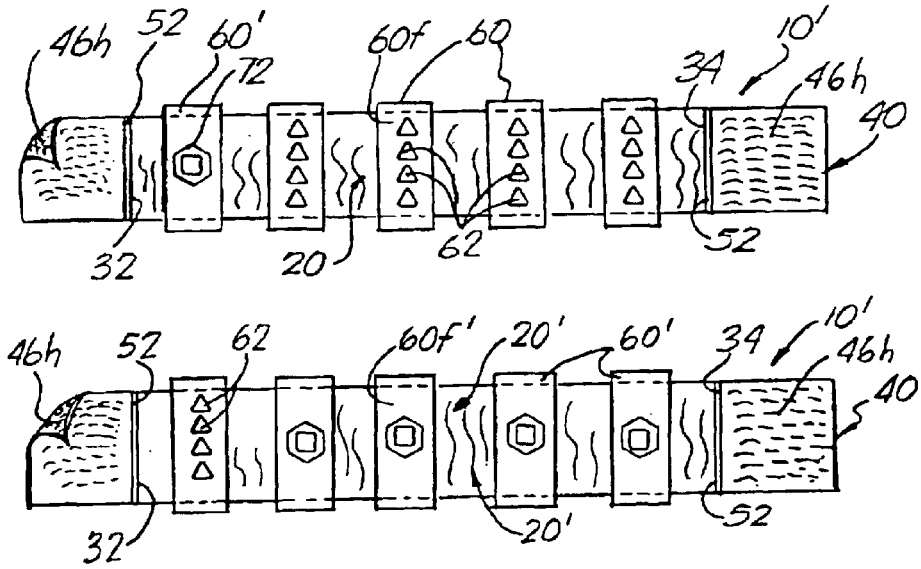
FIG. 6C is a top plan view of the friendship bracelet of the present invention showing each of the closed loop members having different indicia designs thereon on each of the other first and second friendship bracelets.

The friendship bracelet 10, as shown in FIG. 1 of the drawings, include a wristband section 20, closure means 40, and a plurality of closed members 60 having indicia 62 thereon. Band section 20 includes an outer surface layer 22 made of a fabric material 24. Fabric materials 24 used for the outer surface layer 22 include cotton, rayon, nylon, silk, linen, polyester and combinations thereof. Outer surface layer 22 is joined together at a seam line 26 by means of stitching 50, gluing 52 and the like, and having an open space 28 formed thereon for receiving of an elongated elastic strip 30 therein. Elastic strip 30 may be made of elastic materials such as elasticized plastics, rubber, plasticized rubber, elasticized fabric materials and the like. As shown in FIGS. 2 and 3, the elastic strip 30 is disposed in the open space 28 and is connected to fast and second end wall tab members 32 and 34 of band section 20 by means of stitching 50, gluing 52, stapling 54, laser fusing (not shown) and the like. Tab members 32 and 34 include closure means 40 thereon for connecting the end wall tab members 32 and 34 together to form a closed bracelet 10, as depicted in FIG. 1 of the drawings. Closure means 40 can be selected from the group consisting of snaps 42*s* clasps 44*c*, hook and loop tabs or fasteners 46*h*, buckle and tine members 48*b*, hook members, buttons and the like, as depicted in FIGS. 5, 6A, 6B and 6C of the drawings.

Band section 20 further includes a plurality of closed loop members 60 having first indicia 62 thereon. Closed loop members 60 are made of fabric material 64 similar or the same as the outer surface layer 22 that include cotton, rayon, nylon, silk, linen, polyester and combinations thereof. As shown in FIGS. 3 and 4 of the drawings, closed loop member 60 is joined together at a seam line 66 by means of stitching 50, gluing 52 and the like and having an open space 68 formed therein for receiving of the band section 20 therein. Indicia 62 on loop member 60 may be selected from the group consisting of designs such as stars, stripes, hearts, flowers, insects, animals, and the like; colors such as red, blue, green, yellow, purple, pink and the like; and indicia symbols such as letters, initials, names, numbers, sport and hobby insignias, emblems, corporate logos and the like.

As shown in FIGS. 1 through 6C, indicia 62 can be imprinted or embroidered on the front wall section 60f of the loop member 60 or indicia 62 can be a separate component from the loop member 60, such that the indicia member 62 is attached to the front wall section 60*f* of the loop member 60 by means of stitching 50, gluing 52, stapling 54, heat sealing, laser fusion or the like.

The plurality of closed loop members 60 having first indicia 62 thereon are slidably removable from the wristband section 20 of a first user's friendship bracelet 10, and are used for exchanging with other closed loop members 60' having a second indicia 72 thereon from another wristband section 20' of a second user's friendship bracelet 10'. Each of the plurality of closed loop members 60 having first indicia members 62 thereon are used for xchanging with closed loop members 60', 60", or 60'" of other friendship bracelet 10', 10" or 10'" having second, third or fourth indicia symbols 72, 82 and 92 thereon, as depicted in detail by FIGS. 2, 6A to 6C of the drawings.

Figure 8:
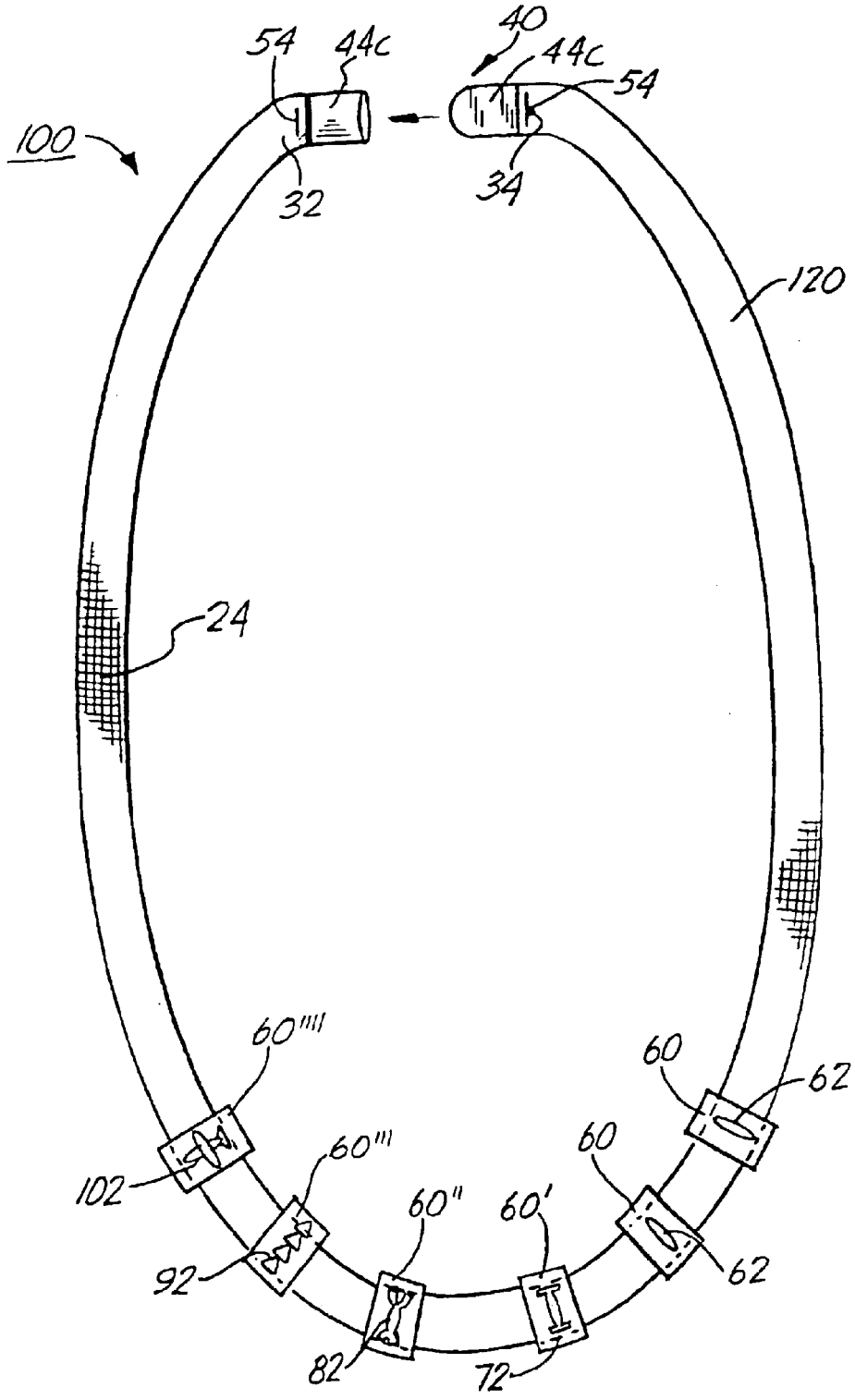
FIG. 8 is a front perspective view of the friendship necklace of the alternate embodiment of the present invention showing the neck band, the clasp, the plurality of closed loop members having different indicia designs thereon; and also showing the friendship necklace in an assembled state having a plurality of closed loop members with different indicia designs thereon and being on the neck band section ready to be worn around the neck by a wearer.

In an alternate embodiment, as shown in FIG. 8, band section 120 can be elongated with or without an inner elastic band section having closure means 40 thereon for the forming of a friendship necklace 100 thereof. In all other aspects the friendship necklace 100 of the alternate embodiment is exactly the same as the friendship bracelet 10 of the preferred embodiment except for the neckband section 120 having an elongated length. Other embodiments of the friendship bracelet 10 can include ankle bracelets, barrettes for hair, tie clasps and headbands, or loop members 60 only for use with shoe or sneaker laces.

METHOD OPERATION OF THE PRESENT INVENTION 400

In operation, the friendship bracelet 10 of a first wearer 12 with that of a second friendship bracelet 10' of a second wearer 12' includes the following steps, as depicted in detail by FIGS. 1, 6A to 7B of the drawings. The first step 410 is the opening of the releasable closure means 40 (e.g. snaps 42*s*, or 44*c* clasps, or Velcro™ tabs 46*h*, or buckle and tine 48*b* or the like) on each wristband section 20 and 20' of each first and second friendship bracelet 10 and 10'. Then the next step 420 is slidably removing from each wristband section 20 and 20', one of the plurality of closed loop members 60 and 60' thereon, where closed loop members and 60' has a first indicia 62 thereon and a second indicia 72 thereon, respectively. The first and second indicia 62 and 72 are different from each other (e.g. first indicia 62 being a design such as a ★ [star], a ▼ [triangle], etc. and the second indicia 72 being a indicia symbol such as initials JCA, a corporate symbol, etc.) and being on each different closed loop members 60 and 60', respectively.

The next step 430 would be the exchanging of each of the removed closed loop members 60 and 60' having first and second indicia 62 and 72 thereon, respectively, such that the first wearer 12 of the first friendship bracelet 10 receives the closed loop member 60' having the second indicia 72 thereon and the second wearer 12' of the second friendship bracelet 10' receives the closed loop member 60 having the first indicia 62 thereon.

The next step 440 is sliding each closed loop member 60 and 60' having the first and second indicia 62 and 72 thereon, on each of the respective exchanged wristbands 20 and 20' of the first and second friendship bracelets 10 and 10', respectively, such that closed loop member 60 having the first indicia 62 thereon is slidably connected to the second wristband section 20' of the second friendship bracel t 10' of the second wearer 12', and the closed loop member 60' having the second indicia 72 thereon is slidably connected to the first wristband section 20 of the first friendship bracelet 10 of the first wearer 12.

The final step 450 is the closing of the releasable closure means 40 on each of the wristband sections 20 and 20' of each first and second friendship bracelets 10 and 10', such that the first wearer 12 of the first friendship bracelet 10 has a plurality of closed loop members 60 and 60' thereon and wristband section 20 has at least one closed loop member 60' having a second indicia 72 thereon; and the second wearer 12' of the second friendship bracelet 10' has a plurality of closed loop members 60 and 60' thereon and wristband section 20' has at least one closed loop member 60 having a first indicia 62 thereon.

It is understood that each friendship bracelet 10 can have several closed loop members 60, 60', 60", 60'" etc., each having different indicia designs, colors or symbols 62, 72, 82, 92, respectively thereon, as depicted in FIG. 1 of the drawings. The operation and method of use of other alternate embodiments would be exactly the same as the preferred embodiment of the present invention of the friendship bracelet 10, where alternate embodiments include friendship ankle bracelets, friendship necklaces, friendship headbands and the like.

ADVANTAGES OF THE PRESENT INVENTION

Accordingly, an advantage of the present invention is that it provides for a novel friendship bracelet with exchangeable elements thereon, wherein the bracelet is made of a stretchable band covered with a fabric and having means for fastening the ends together.

Another advantage of the present invention is that it provides for a friendship bracelet wherein the exchangeable elements are in the form of a plurality of closed loop members having indicia thereon.

Another advantage of the present invention is that it provides for a friendship bracelet that may be worn by adults, teenagers, IF and children of both sexes for indicating membership in friendship groups, cliques, clubs and the like.

Another advantage of the present invention is that it provides for a friendship bracelet wherein the indicia may be any design such as designs selected from the group consisting of stars, stripes, hearts, flowers, insects, animals and the like; colors such as red, blue, green, yellow, purple, pink and the like; and 1indicia symbols such as letters, numbers, initials, names, insignias, emblems and the like.

Another advantage of the present invention is that it provides for a friendship bracelet wherein the fastening means for fastening the bracelet ends together include snaps, clasps, hook and loop fasteners (Velcro™ fasteners), buckle and tine members, hook members, or buttons and the like.

Another advantage of the present invention is that it provides for a friendship bracelet wherein the bracelet is made of a stretchable elastic band covered with an outer layer of fabric material, in which the fabric material is selected from the group consisting of cotton, rayon, nylon, silk, linen, polyester and combinations thereof.

Another advantage of the present invention is that it provides for a friendship bracelet that is durable, lightweight and cleanable by washing for extending the useful life of the bracelet.

A still further advantage of the present invention is that it provides for a friendship bracelet that can be mass produced in an automated and economical manner and is readily affordable by the wearer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A friendship band with a plurality of close loop members, comprising:

a) a band section made of a first material that is flat in cross section, is stretchable, and has first and second ends;

b) a closure means attached to the first and second ends of the band section for releasably connecting the first end to the second end; and o) the plurality of closed loop members slidably mounted on the band section, wherein each closed loop member is made of a second material that is flat in cross-section, has a loop opening that conforms to the cross-section of the band section when mounted thereon, includes an indicia on a portion of an exposed surface thereof, and is removable from the first or second end of the lead section so as to be exchangeable with one or more slidably removable closed loop members of other friendship bands.

2. A friendship band as recited in claim 1, wherein the first material is an elastic material.

3. A friendship band as recited in claim 2, wherein the first material is selected from the group consisting of elasticized plastics, rubber, plasticized rubber, elasticized fabric materials, and combinations thereof.

4. A friendship band as recited in claim 1, wherein the second material is an elastic material.

5. A friendship band as recited in claim 4, wherein the second material is selected from the group consisting of nylon and silk.

6. A friendship band as recited in claim 1, wherein at least one of the first and second closure means is a clasp with a cross-section that is larger than the loop opening of each closed loop member.

7. A friendship band as recited in claim 1, wherein the indicia included on a portion of an exposed surface of each closed loop member is selected from the group consisting of letters, numbers, insignias, emblems, corporate logos, stars, stripes, luearls, flowers, insects, and animals.

8. A friendship band as recited in claim 1, wherein the indicia included on a portion of an exposed surface of each closed loop member is embroidered into the exposed surface.

9. A friendship band as recited in claim 1, wherein the second material is a fabric material that is joined at a seam line by a mechanism selected from the group consisting of stitches, glue, staples, and laser fusion.

10. A friendship band as recited in claim 1, wherein the first material and second material are the same material.

11. A friendship band as recited in claim 1, wherein the band section is elongated so the friendship band can be worn as a necklace.

12. A friendship band as recited in claim 1, further comprising an outer surface layer enclosing the band section except for an open section comprising an electric strip.

13. A friendship band as recited in claim 12, wherein the outer surface layer is made of material selected from the group consisting of cotton, rayon, nylon, silk, linen, polyester, and combinations thereof.

14. A friendship band as recited in claim 12, wherein the outer surface layer is joined to the band section proximate the first and second ends by a mechanism selected from the group consisting of stitchers, glue, staples, and laser fusion.

15. A method of using a first friendship band and a second friendship band, comprising:

a) providing the first friendship band including a hand section having closure means for connecting ends of the band section, and a plurality of closed loop members each having a first indicia thereon and mounted onto the band section;

b) opening the closure means of the first friendship band and removing one of the plurality of closed loop members having first indicia thereon;

c) exchanging the removed one of the plurality of closed loop members with a closed loop members having a second indicia thereon removed from the second friendship band; and d) replacing the closed loop member having a second indicia thereon onto the first friendship band and connecting the closure means thereof.

16. A method of using a first friendship band and a second friendship band, comprising:

a) providing the first friendship band including a first band section having closure means for connecting ends of the first band section, and a plurality of closed loop members each having a first indicia thereon and mounted onto the first band section of the first friendship band;

b) providing the second friendship band including a second band section having closure means for connecting ends of the second band section, and a plurality of closed loop members each having a second indicia thereon and mounted onto the second band section of the second friendship band;

c) opening the closure means of the first friendship band and removing one of the plurality of closed loop members having first indicia thereon;

d) opening the closure means of the second friendship band and removing one of the plurality of closed loop members having second indicia thereon;

e) replacing the one of the plurality of closed loop members having first indicia thereon onto the second band section of the second friendship band and connecting the closure means thereof; and f) replacing the one of the plurality of closed loop members having second indicia thereon onto the first band section of the first friendship band and connecting the closure means thereof.

* * * * *